US011131318B2

(12) United States Patent
Webb

(10) Patent No.: US 11,131,318 B2
(45) Date of Patent: Sep. 28, 2021

(54) CENTRIFUGAL PUMP

(71) Applicant: Daniel Scott Webb, Greenwood Village, CO (US)

(72) Inventor: Daniel Scott Webb, Greenwood Village, CO (US)

( * ) Notice: Subject to any disclaimer, the term of this patent is extended or adjusted under 35 U.S.C. 154(b) by 130 days.

(21) Appl. No.: 16/296,947

(22) Filed: Mar. 8, 2019

(65) Prior Publication Data

US 2019/0277303 A1 Sep. 12, 2019

Related U.S. Application Data

(60) Provisional application No. 62/640,580, filed on Mar. 9, 2018.

(51) Int. Cl.

| | |
|---|---|
| ***F04D 29/22*** | (2006.01) |
| ***F04D 29/42*** | (2006.01) |
| ***F04D 1/04*** | (2006.01) |
| *F04D 29/62* | (2006.01) |

(52) U.S. Cl.

CPC ..... *F04D 29/2255* (2013.01); *F04D 1/04* (2013.01); *F04D 29/4293* (2013.01); *F04D 29/628* (2013.01); *F05D 2250/51* (2013.01)

(58) Field of Classification Search

CPC ..... F04D 29/2255; F04D 29/4293; F04D 29/628; F04D 29/426; F04D 29/2238; F04D 1/04; F04D 29/22; F04D 29/44; F05D 2250/51

See application file for complete search history.

(56) References Cited

U.S. PATENT DOCUMENTS

| | | | | |
|---|---|---|---|---|
| 873,644 | A * | 12/1907 | Wickblom | F01D 15/062 415/25 |
| 967,122 | A * | 8/1910 | Hall | F04D 1/12 415/88 |
| 3,225,930 | A * | 12/1965 | Willinger | A01K 63/047 210/241 |
| 3,791,757 | A * | 2/1974 | Tarifa | F16D 25/0638 415/89 |
| 5,234,320 | A * | 8/1993 | Domenge | F04D 9/005 239/587.1 |

FOREIGN PATENT DOCUMENTS

CN 204458191 U * 7/2015

* cited by examiner

*Primary Examiner* — Igor Kershteyn
*Assistant Examiner* — Joshua R Beebe
(74) *Attorney, Agent, or Firm* — Roger A. Jackson

(57) ABSTRACT

A centrifugal pump that includes an inlet chamber having a distal end portion and an opposing proximal end portion with a longitudinal axis spanning therebetween. Further included in the centrifugal pump is a plenum chamber having an inlet end portion and an outlet end portion, the inlet end portion is in fluid communication with the inlet chamber proximal end portion, the outlet end portion having an aperture that is about a radial axis that extends radially a distance outward from the longitudinal axis. Wherein operationally for the centrifugal pump the inlet chamber and the inlet and plenum chambers are rotated about the longitudinal axis wherein a fluid is drawn through the distal end portion toward the proximal end portion and ultimately discharged therethrough the aperture.

7 Claims, 14 Drawing Sheets

CENTRIFUGAL PUMP

RELATED APPLICATION

This application claims the benefit of U.S. provisional patent application Ser. No. 62/640,580 filed on Mar. 9, 2018 by Daniel Scott Webb of Greenwood Village, CO, U.S.

FIELD OF THE INVENTION

The present invention generally relates to centrifugal pumps for moving a fluid. More particularly, the present invention discloses a special centrifugal pump having an open discharge that can accommodate various attachments that utilize fluid flow components for the generation of electricity, filtration, and the like.

DESCRIPTION OF THE RELATED ART

Centrifugal pumps move fluid via dynamic motion only being typically a blade disposed within a fluid bowl wherein the blade is moving in a continuous motion-making for relatively smooth flow and usually no contacting parts within the pump, that helps to ensure a long trouble free life of the pump (that can usually run dry also without damage) that has numerous applications such as an engine coolant pump, drinking water pump, and many other applications were an excessive pressure rise is not needed and where the pump suction inlet is flooded with some amount of positive fluid pressure is where a centrifugal pump is used. Otherwise, if excessive pressure rise is needed and/or the pump actually has to draw in fluid via a vacuum to suck the fluid upward into the pump inlet other type pumps are used such as positive displacement being diaphragm, gear, or piston type of which do have contacting and wearing parts (typically not being able to run dry without damage).

A certain type of centrifugal pump that has an open discharge is sometimes called a "centrifuge" by virtue of having radially oriented passage ways perpendicularly positioned to an axis of rotation, although the typical centrifuge has a closed outlet for the purpose of separating a fluid into components via centrifugal force, i.e. for blood to separate cells and plasma. Other centrifuges have an open outlet that also separates fluid components but as opposed to blood, these are continuous flow type centrifuges that for instance separate sand from water on a continuous flow basis.

Thus the following prior art has a focus on continuous flow centrifuges starting with U.S. Pat. No. 3,967,777 to Canevari., that discloses an apparatus for the treatment of tar sands using a centrifuge using a rotating portable drum plus having separation channels with the ports 72 that capture the heavy particles due to centrifugal force to separate heavy from light particles in the tar sands.

Continuing in the prior art for continuous flow centrifuges in U.S. Pat. No. 5,468,396 to Allen, discloses a centrifugal cleaning of pulp and paper process liquids that uses a centrifuge that has outlet ports and disc channels to separate the light and heavy particles in solution.

Next, in the prior art for continuous flow centrifuges in U.S. Pat. No. 5,944,648 to Cornay, discloses a concentric tubular centrifuge for separating light from heavy material in a fluid utilizing a rotating assembly with multiple concentric tubes that drives the heavy material to the outer periphery portion with the lighter material migrating toward the inner portion of the centrifuge, wherein the inner tube has a rotating helical screw to help in moving high viscosity fluid in the tube.

Further, in the prior art for continuous flow centrifuges in U.S. Pat. No. 6,142,924 to Cornay, that is a continuation of Cornay '648 meaning it is the same teaching disclosure with a different set of claims.

Moving onward, in the prior art for a closed outlet centrifuge in U.S. Pat. No. 6,152,868 to Walters, disclosed is an inertial tube indexer that is used in a centrifuge that uses a radial tube that calibrates different blood properties based upon the radial position in the tube.

Next, in the prior art for continuous flow centrifuges in United States Patent Application Publication Number US 2002/0032111 to Cornay, disclosed is a concentric tubular centrifuge for separating light from heavy material in a fluid utilizing a rotating assembly with multiple concentric tubes that drives the heavy material to the outer periphery portion with the lighter material migrating toward the inner portion of the centrifuge, wherein the inner tube has a rotating helical screw to help in moving high viscosity fluid in the tube, this is similar to Cornay '648 except for design revisions in the rotating helical screw drive.

Continuing, in the prior art for continuous flow centrifuges in United States Patent Application Publication Number US 2004/0142807 to Cornay, that discloses a concentric centrifuge again similar to Cornay '2111 with differences in the tube shape configuration and the helical screw drive.

Also, in the prior art for continuous flow centrifuges in United States Patent Application Publication Number US 2005/0054507 to Cornay, that discloses a concentric centrifuge again similar to Cornay '2111 with differences in the tube sealing configuration and the helical screw drive.

This gives an idea of the current state of the art in the centrifuge related arts via using centrifugal pump principals for a variety of applications with a search focus on tube type centrifugal pump impeller passageways starting with Canevari having a rotating drum with tubular outlets, plus Allen being similar to Canevari in a centrifuge with channels and outlet ports with a different outer housing, Cornay has a number of special purpose centrifuges with concentric tubes and an axial pump screw, and Walters has another special purpose centrifuge for blood property detection within a radial tube position.

What is needed is a specific application centrifuge system that is adapted for multiple outlet component attachment uses that includes items such as central chamber tube sizing and specifics as to material, size, length, plus chamber to chamber porting size and configuration, and unique rotational support structure properties such as bearing/drives, and the like.

SUMMARY OF INVENTION

Broadly, the present invention is a centrifugal pump that includes an inlet chamber having a distal end portion and an opposing proximal end portion with a longitudinal axis spanning therebetween. Further included in the centrifugal pump is a plenum chamber having an inlet end portion and an outlet end portion, the inlet end portion is in fluid communication with the inlet chamber proximal end portion, the outlet end portion having an aperture that is about a radial axis that extends radially a distance outward from the longitudinal axis. Wherein operationally, for the centrifugal pump the inlet chamber and the inlet and plenum chambers are rotated about the longitudinal axis wherein a fluid is drawn through the distal end portion toward the proximal end portion and ultimately discharged therethrough the aperture.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 2 shows a cross section of the FIG. 1 upper perspective view of the centrifugal pump, wherein FIG. 2 shows the inlet chamber with an inlet chamber interior about the longitudinal axis, the plenum chamber with a plenum chamber interior, plus the aperture having a primary end portion and a secondary end portion, and with the radial axis and the radial axis distance shown;

FIG. 10 shows cross section cut 10-10 from FIG. 14, of the annular centrifugal pump, wherein FIG. 10 shows a fluid flow circuit that comes from operationally rotating an inlet chamber, a distribution chamber, a fluid flow primary extension element, a primary open channel annulus, a fluid flow secondary extension element, the fluid flow electrical turbine generator, a secondary open channel annulus, and a fluid flow tertiary extension element, all rotated about a rotational axis to functionally cause an endless continuous loop of fluid flow that includes drawing a fluid through a distal end portion toward a proximal end portion of a an inlet chamber, then having fluid communication between the inlet chamber proximal end portion and an inlet end portion, then toward having fluid communication of an inlet chamber interior to a distribution chamber interior, then further discharging the fluid through a distribution aperture, toward fluid communication from the distribution aperture to the fluid flow electrical turbine generator via the fluid flow primary extension element to a primary open channel annulus via a fluid flow secondary extension element to the electrical turbine generator and then further to a fluid communication from the electrical turbine generator to a secondary open channel annulus and then through a fluid flow tertiary extension element to the inlet chamber, note that the above defined fluid flow circuit is shown in the singular for clarity, however, there could be a plurality of fluid flow circuits arranged in a spoke radial fashion emanating from the inlet and distribution chambers as shown in FIG. 13;

FIG. 11 shows cross section cut 11-11 from FIG. 14, of the annular centrifugal pump, wherein FIG. 11 shows a fluid flow circuit that comes from operationally rotating an inlet chamber, a distribution chamber, a fluid flow primary extension element, a primary open channel annulus, a fluid flow secondary extension element, and the fluid flow electrical turbine generator only as about the rotational axis, as the secondary open channel annulus, the fluid flow tertiary extension element, and the suction reservoir are all static about the rotational axis to functionally cause an endless continuous loop of fluid flow that includes drawing a fluid through the suction reservoir to the distal end portion toward a proximal end portion of a an inlet chamber, then having fluid communication between the inlet chamber proximal end portion and an inlet end portion, then toward having fluid communication of an inlet chamber interior to a distribution chamber interior, then further discharging the fluid through a distribution aperture, toward fluid communication from the distribution aperture to the fluid flow electrical turbine generator via the fluid flow primary extension element to a primary open channel annulus via a fluid flow secondary extension element to the electrical turbine generator and then further to a fluid communication from the electrical turbine generator to a secondary open channel annulus and then through a fluid flow tertiary extension element to the suction reservoir and then to the inlet chamber, note that the above defined fluid flow circuit is shown in the singular for clarity, however, there could be a plurality of fluid flow circuits arranged in a spoke radial fashion emanating from the common inlet and distribution chamber as shown in FIG. 13;

FIG. 12 shows cross section cut 12-12 from FIG. 14, of the annular centrifugal pump, wherein FIG. 12 shows a fluid flow circuit that comes from operationally rotating an inlet chamber, a distribution chamber, and a fluid flow primary extension element only about the rotational axis, wherein the primary open channel annulus, the fluid flow secondary extension element, the fluid flow electrical turbine generator, the secondary open channel annulus, the fluid flow tertiary extension element, and the suction reservoir all are static about the rotational axis to functionally cause an endless continuous loop of fluid flow that includes drawing a fluid through the suction reservoir to the distal end portion toward a proximal end portion of a an inlet chamber, then having fluid communication between the inlet chamber proximal end portion and an inlet end portion, then toward having fluid communication of an inlet chamber interior to a distribution chamber interior, then further discharging the fluid through a distribution aperture, toward fluid communication from the distribution aperture to the fluid flow electrical turbine generator via the fluid flow primary extension element to a primary open channel annulus via a fluid flow secondary extension element to the electrical turbine generator and then further to a fluid communication from the electrical turbine generator to a secondary open channel annulus and then through a fluid flow tertiary extension element to the inlet chamber, note that the above defined fluid flow circuit is shown in the singular for clarity, however, there could be a plurality of fluid flow circuits arranged in a spoke radial fashion emanating from the inlet and distribution chambers as shown in FIG. 13;

REFERENCE NUMBERS IN DRAWINGS

Figure 1:
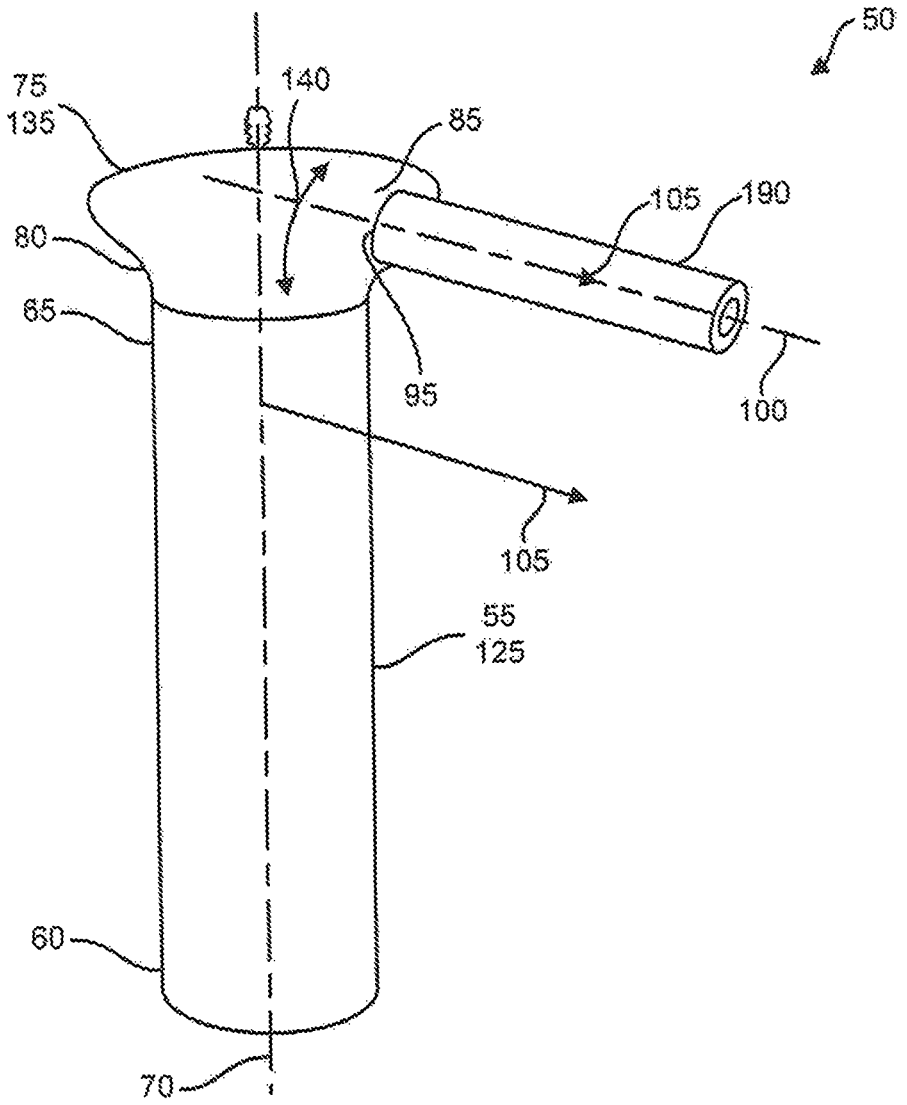
FIG. 1 shows an upper perspective view of the centrifugal pump that includes an inlet chamber about a longitudinal axis, a plenum chamber, and an aperture with a radial axis with a radial axis distance.

50 Centrifugal pump
55 Inlet chamber
60 Distal end portion of the inlet chamber 55
65 Proximal end portion of the inlet chamber 55
70 Longitudinal axis
75 Plenum chamber
80 Inlet end portion of the plenum chamber 75
85 Outlet end portion of the plenum chamber 75
90 Fluid communication between the inlet chamber proximal end portion 65 and the inlet end portion 80
95 Aperture
100 Radial axis of the aperture 95
105 Distance extension of the radial axis 100
110 Fluid
115 Drawing the fluid 110 through the distal end portion 60 toward the proximal end portion 65
120 Discharging the fluid 110 through the aperture 95
125 First surrounding sidewall of the inlet chamber 55
130 Interior of the inlet chamber 55
135 Second surrounding sidewall of the plenum chamber 75
140 Encompassing of the second surrounding sidewall 135 from the inlet portion 80 to the outlet end portion 85
145 Interior of the plenum chamber 75
150 Fluid communication of the inlet chamber 55 interior 130 to the plenum chamber 75 interior 145
155 Aperture 95 disposed therethrough the second sidewall 135
160 Primary end portion of the aperture 95
165 Secondary end portion of the aperture 95
170 Fluid filter
175 Fluid communication from the aperture 95 secondary end portion 165 to the fluid filter 170
180 Fluid flow electrical generator
185 Fluid communication from the aperture 95 secondary end portion 165 to the fluid flow electrical generator 180
190 Fluid flow extension element
195 Fluid communication from the aperture 95 secondary end portion 165 to the fluid flow extension element 190
200 Outward fluid 110 flow diversion element
205 Routing fluid 110 flow from the inlet chamber 55 interior 130 to adjacent to the second surrounding sidewall 135 and the primary end portion 160 of the aperture 95 via the diversion element 200
210 Rotating the inlet chamber 55 and the plenum chamber 75 about the longitudinal axis 70
300 Annular centrifugal pump
305 Inlet chamber of the annular centrifugal pump 300
310 Distal end portion of the inlet chamber 305
315 Proximal end portion of the inlet chamber 305
316 Open suction reservoir
320 Rotational axis
325 Distribution chamber
330 Inlet end portion of the distribution chamber 325
335 Outlet end portion of the distribution chamber 325
340 Fluid communication between the inlet chamber 305 proximal end portion 315 and the inlet end portion 330
345 Distribution aperture
350 Radial axis of the aperture 345
355 Outward distance extension of the radial axis 350
360 Fluid
365 Drawing the fluid 360 through the distal end portion 310 or the suction reservoir 316 toward the proximal end portion 315
370 Discharging the fluid 360 through the distribution aperture 345
375 First surrounding sidewall of the inlet chamber 305
380 Interior of the inlet chamber 305
385 Second surrounding sidewall of the distribution chamber 325
390 Encompassing of the second surrounding sidewall 385 from the inlet end portion 330 to the outlet end portion 335
395 Interior of the distribution chamber 325
400 Fluid communication of the inlet chamber 305 interior 380 to the distribution chamber 325 interior 395
405 Distribution aperture 345 disposed therethrough the second surrounding sidewall 385
410 Primary end portion of the distribution aperture 345
415 Secondary end portion of the distribution aperture 345
420 Fluid flow electrical turbine generator
421 Inlet of the electrical turbine generator
422 Outlet of the electrical turbine generator
425 Fluid communication from the aperture 345 secondary end portion 415 to the fluid flow electrical turbine generator 420 via the primary extension element 430 to the primary open channel annulus 440 via the secondary extension element 445 to the electrical turbine generator inlet 421
430 Fluid flow primary extension element
435 Fluid communication from the distribution aperture 345 secondary end portion 415 to the fluid flow primary extension element 430
440 Primary open channel annulus that is affixed to both the fluid flow primary extension element 430 and the fluid flow secondary extension element 445
441 Primary open channel annulus that is not affixed to the fluid flow primary extension element
430 and affixed to the fluid flow secondary extension element 445
445 Fluid flow secondary extension element
450 Secondary open channel annulus
451 Support for the electrical turbine generator outlet 422 suspended over the secondary open channel annulus 450 wherein the support 451 allows flow therethrough the aperture 452 from the electrical turbine generator outlet 422 to the secondary open channel annulus 450

452 Aperture of the support 451

455 Fluid flow tertiary extension element

460 Fluid communication from the electrical turbine generator outlet 422 therethrough the support 451 aperture 452 to the secondary open channel annulus 450 and then through the tertiary extension element 455 to the inlet chamber 305

465 Rotating the inlet chamber 305, the distribution chamber 325, the fluid flow primary extension element 430, the primary open channel annulus 440, the fluid flow secondary extension element 445, the fluid flow electrical turbine generator 420, the secondary open channel annulus 450, and the fluid flow tertiary extension element 455 all about the rotational axis 320 to operationally cause an endless continuous loop of fluid flow that includes drawing 365 the fluid 360 through the distal end portion 310 toward the proximal end portion 315, then fluid communication 340 between the inlet chamber 305 proximal end portion 315 and the inlet end portion 330, then to fluid communication 400 of the inlet chamber 305 interior 380 to the distribution chamber 325 interior 395, then further discharging 370 the fluid 360 through the aperture 345, toward fluid communication 425, 435 from the aperture 345 secondary end portion 415 to the fluid flow electrical turbine generator 420 via the primary extension element 430 to the primary open channel annulus 440 via the secondary extension element 445 to the electrical turbine generator inlet 421, and then further to the fluid communication 460 from the electrical turbine generator outlet 422 therethrough the support 451 aperture 452 to the secondary open channel annulus 450 and then through the tertiary extension element 455 to the inlet chamber 305

DETAILED DESCRIPTION

Figure 2:
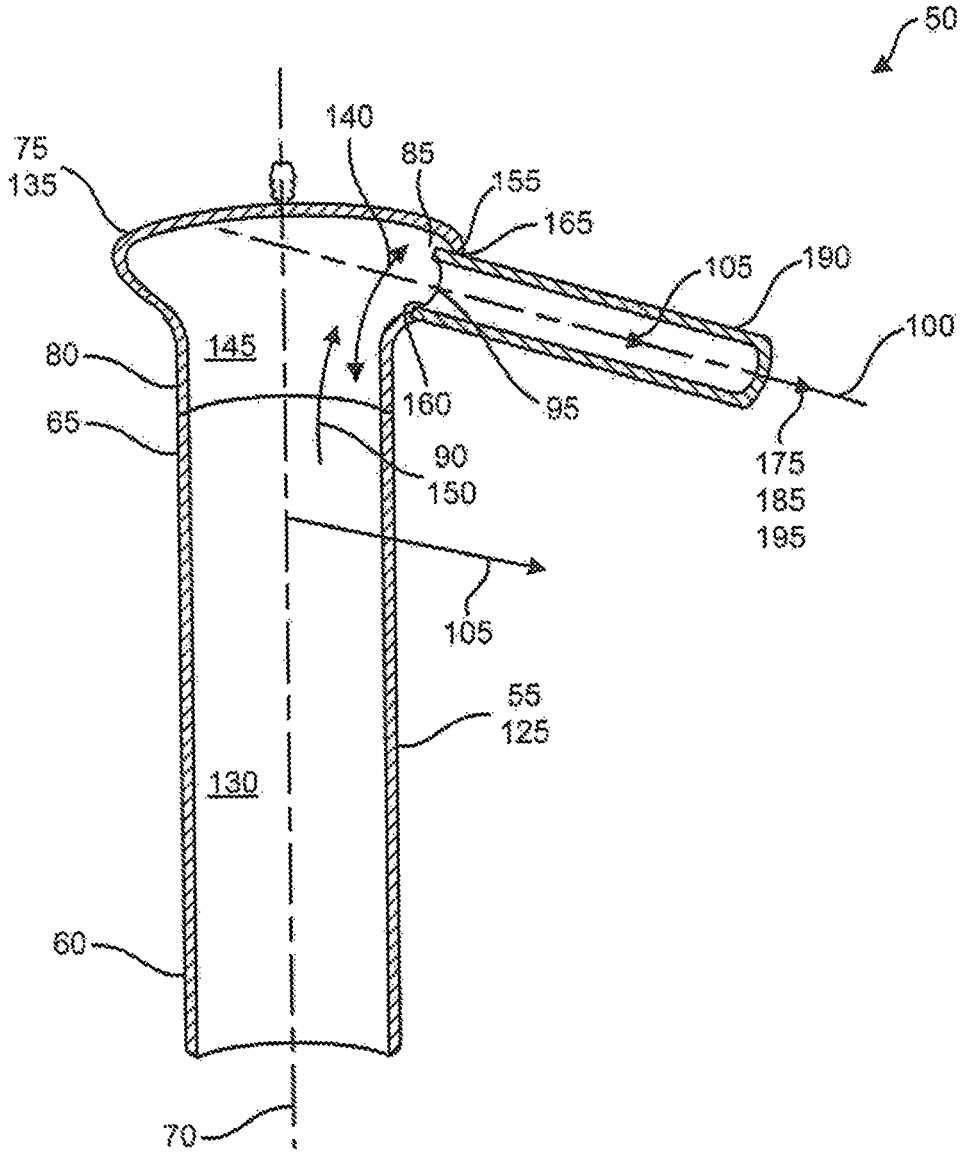

With initial reference to FIG. 1 shown is the upper perspective view of the centrifugal pump 50 that includes the inlet chamber 55 about the longitudinal axis 70, the plenum chamber 75, the aperture 95 and with the radial axis 100 having the radial axis 100 distance 105. Next, FIG. 2 shows a cross section of the FIG. 1 upper perspective view of the centrifugal pump 50, wherein FIG. 2 shows the inlet chamber 55 with the inlet chamber interior 130 about the longitudinal axis 70, the plenum chamber 75 with the plenum chamber 75 interior 145, plus the aperture 95 having the primary end portion 160 and the secondary end portion 165, with the radial axis 100 and the radial axis 100 distance shown 105.

Figure 3:
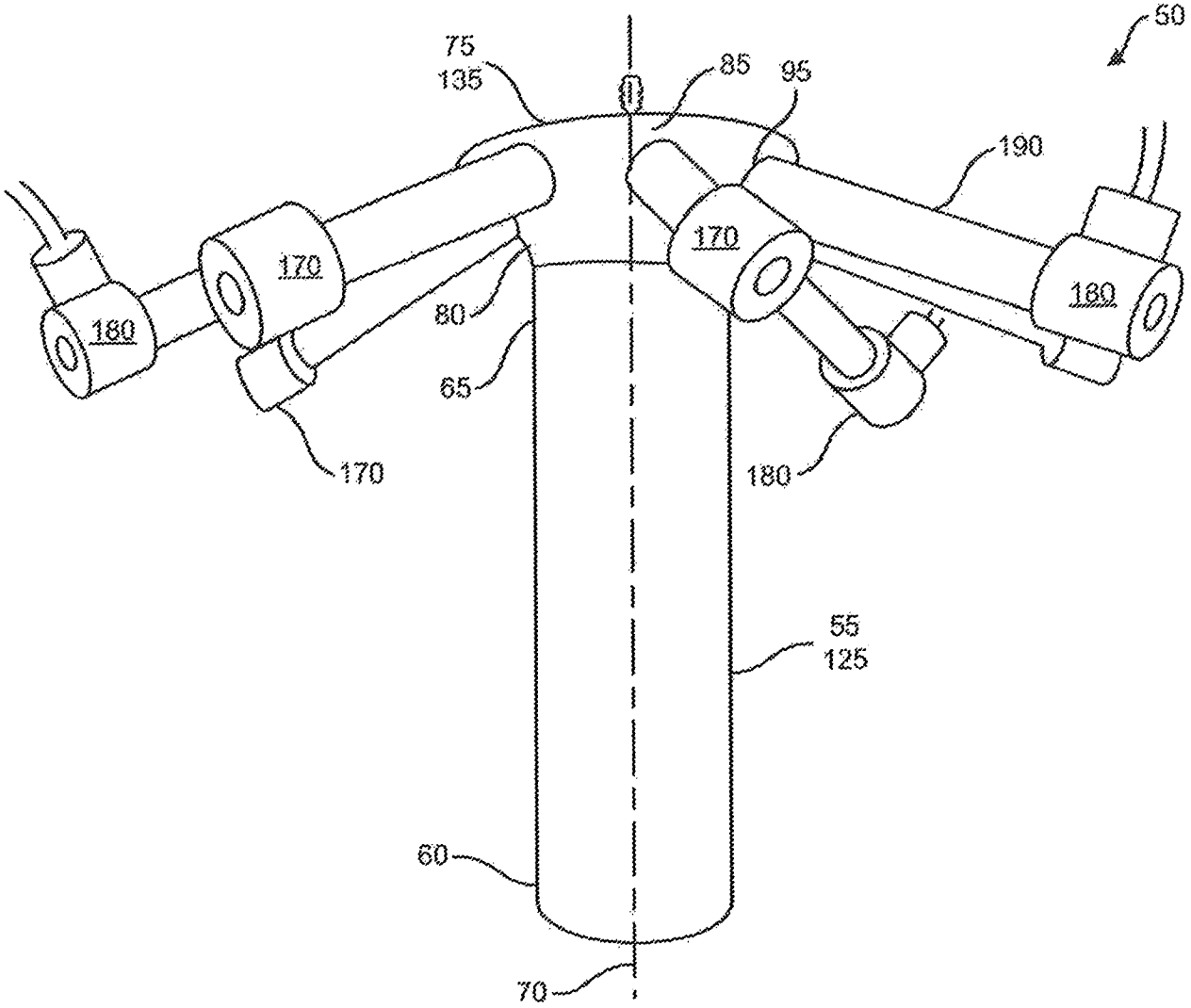
FIG. 3 shows a perspective view of the centrifugal pump that includes the inlet chamber about the longitudinal axis, the plenum chamber, and with a plurality of apertures.
Figure 4:
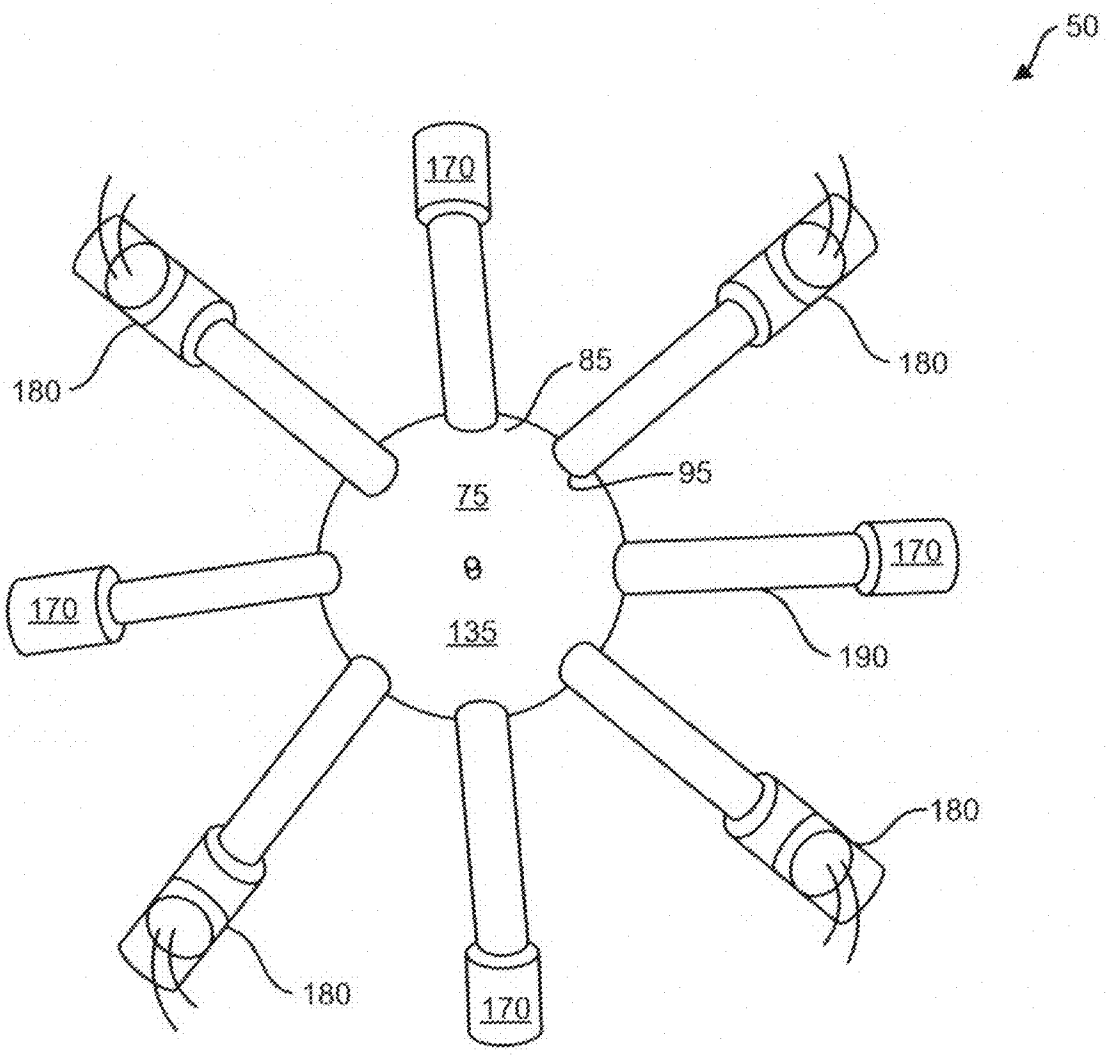
FIG. 4 shows a top plan view of the centrifugal pump that includes the inlet chamber about the longitudinal axis, the plenum chamber, and with the plurality of apertures.

Continuing, FIG. 3 shows a perspective view of the centrifugal pump 50 that includes the inlet chamber 55 about the longitudinal axis 70, the plenum chamber 75, with the plurality of apertures 95. Further, FIG. 4 shows a top plan view of the centrifugal pump 50 that includes the inlet chamber 55 about the longitudinal axis 70, the plenum chamber 75, with the plurality of apertures 95.

Figure 5:
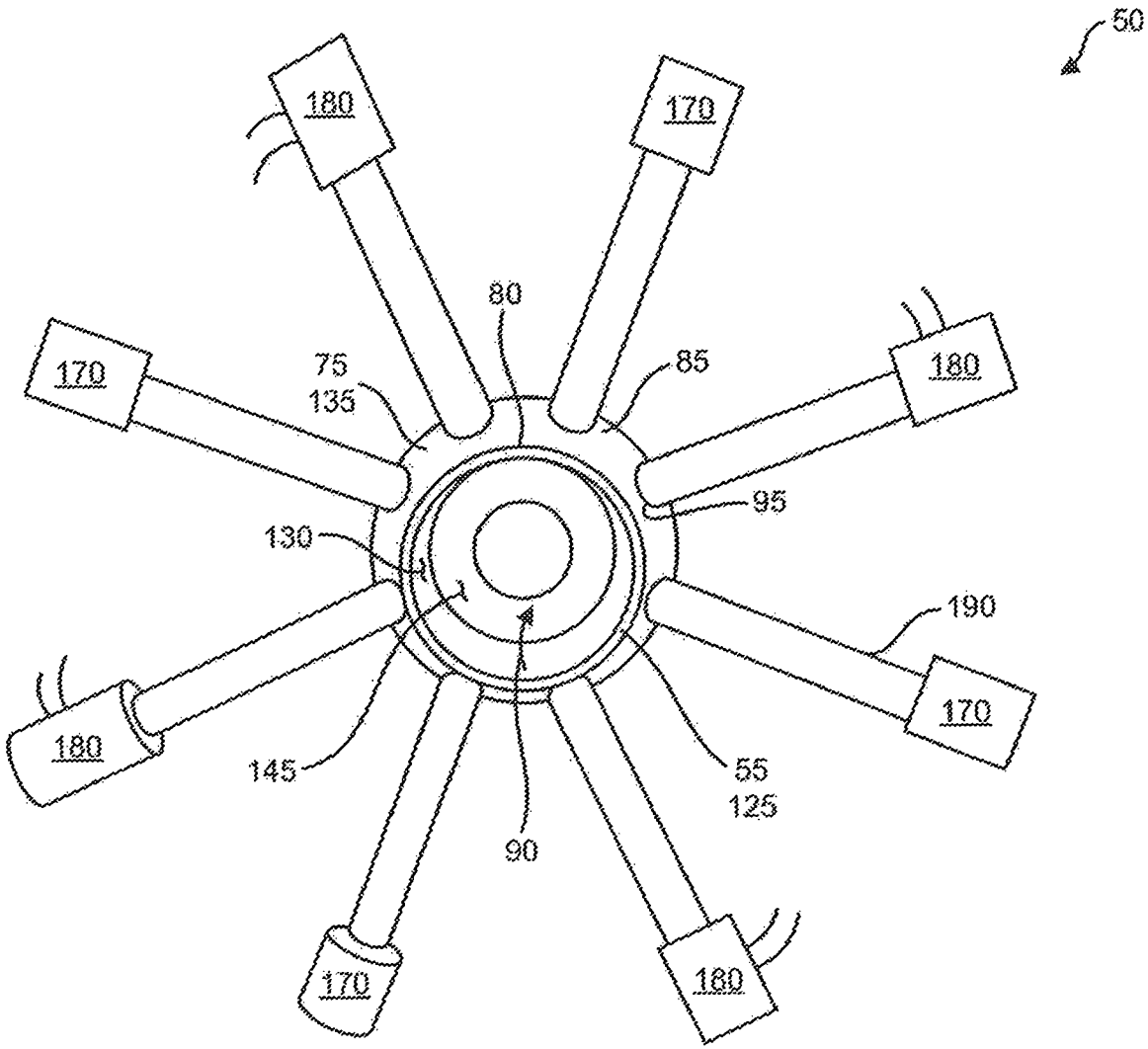
FIG. 5 shows a bottom plan view of the centrifugal pump that includes the inlet chamber about the longitudinal axis, the plenum chamber, and the plurality of apertures, further shown is the interior of the inlet chamber and the interior of the plenum chamber.

Yet further, FIG. 5 shows a bottom plan view of the centrifugal pump 50 that includes the inlet chamber 55 about the longitudinal axis 70, the plenum chamber 75, and the plurality of apertures 95, further shown is the interior 130 of the inlet chamber 55 and the interior 145 of the plenum chamber 75. Next, FIG. 6 shows the cross section of FIG. 2, with the centrifugal pump 50 inlet chamber 55 and the plenum chamber 75 immersed in the fluid 110 up to the aperture 95 primary end portion 160 in order to place the centrifugal pump 50 in a primed to fluid 110 flow communication 90, 115, 120, 150, 205 operational state.

Figure 6:
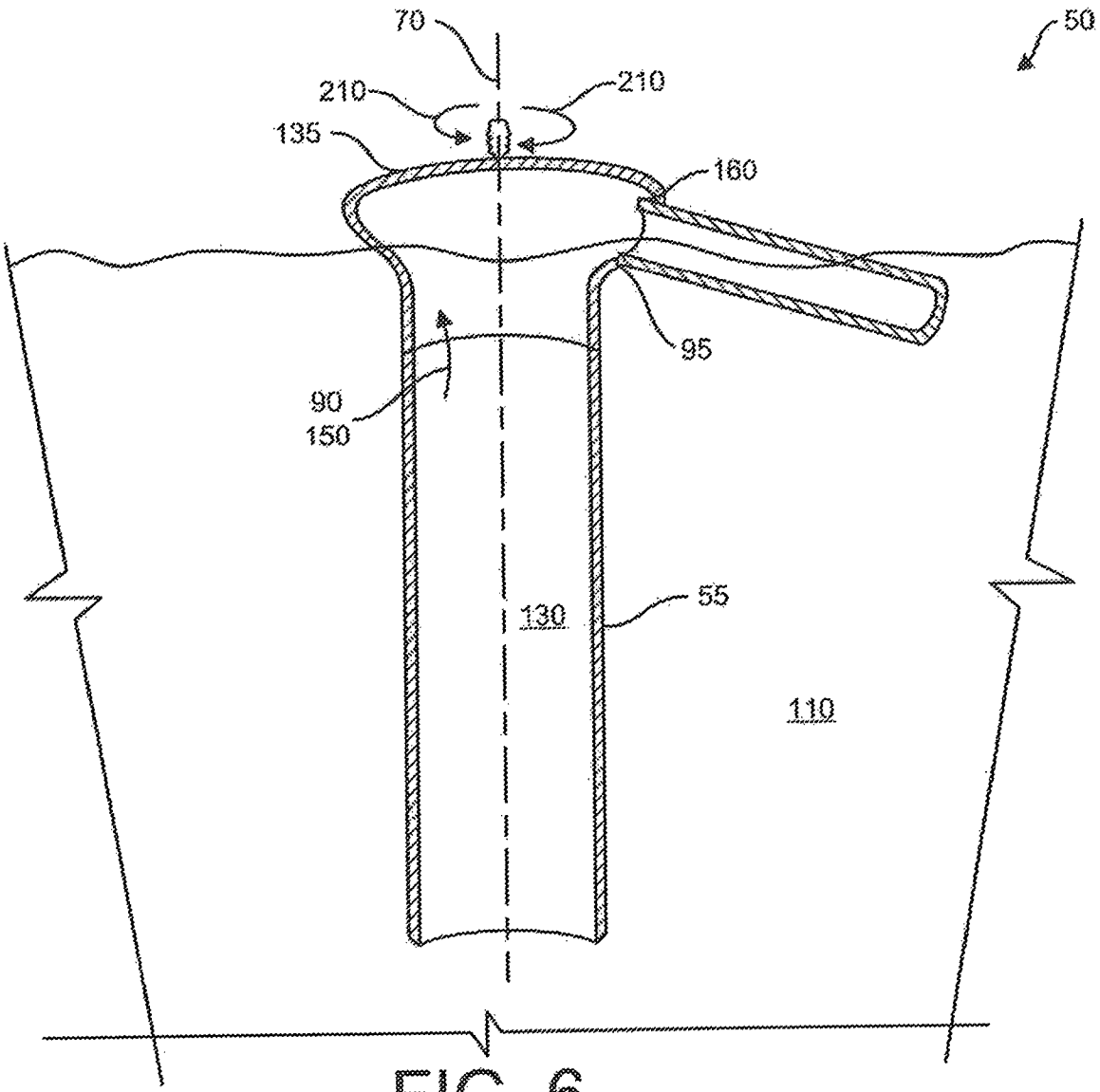
FIG. 6 shows the cross section of FIG. 2, with the centrifugal pump inlet chamber and the plenum chamber immersed in the fluid up to the aperture primary end portion in order to place the centrifugal pump in a prime operational state.
Figure 7:
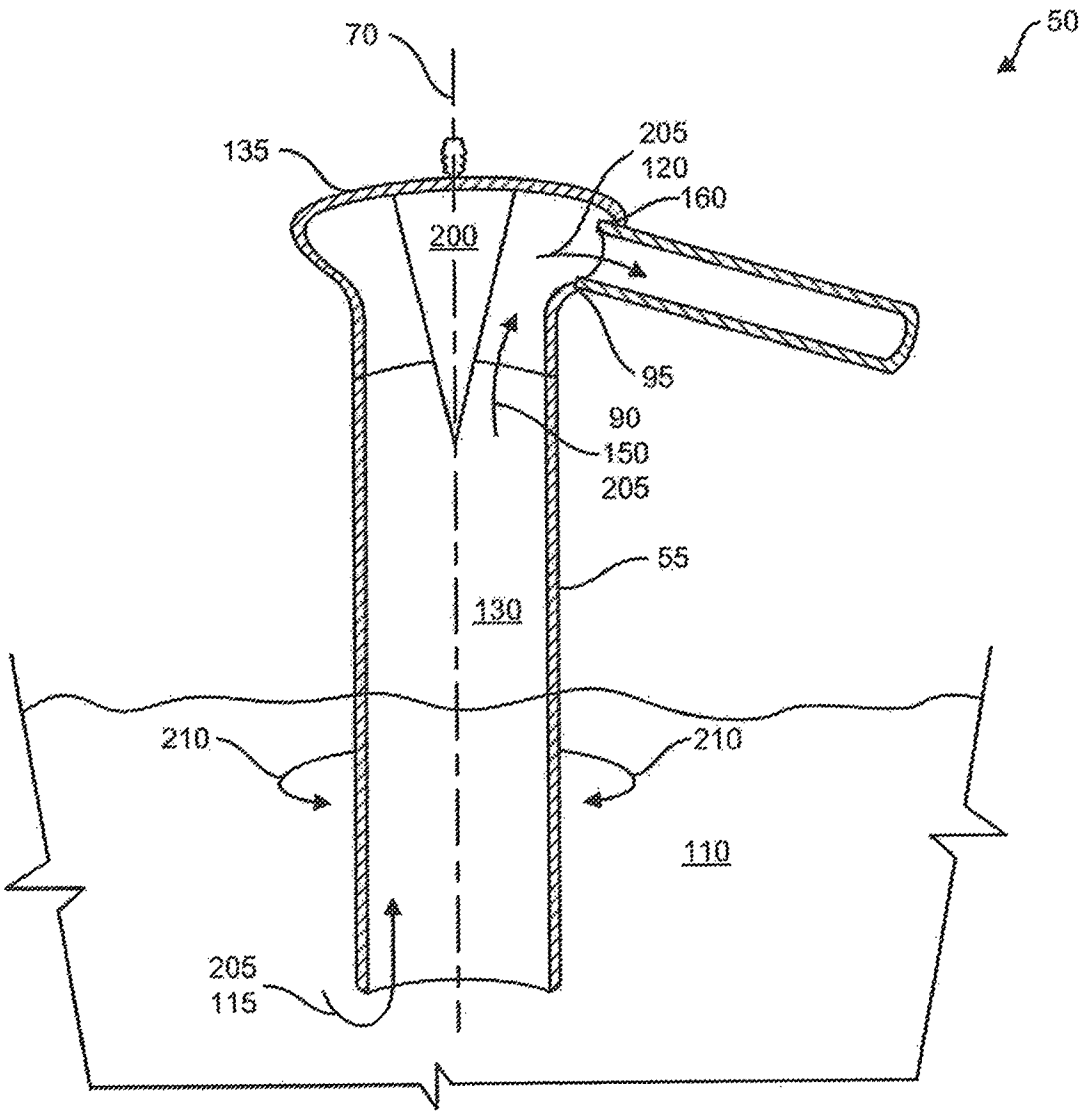
FIG. 7 shows the cross section of FIG. 6, with the centrifugal pump inlet chamber, the plenum chamber, and the aperture primary end portion is elevated out of the fluid as shown while the inlet and plenum chambers are rotated to start fluid communication via drawing the fluid through the distal end portion of the first surrounding sidewall through the inlet chamber interior towards the proximal end portion of the inlet chamber and then continuing the fluid communication to being adjacent to the plenum chamber second surrounding sidewall and plenum chamber interior going to the primary end portion of the aperture thus resulting overall in fluid flow from the distal end portion of the inlet chamber to the aperture while the inlet and plenum chambers are rotated.
Figure 8:
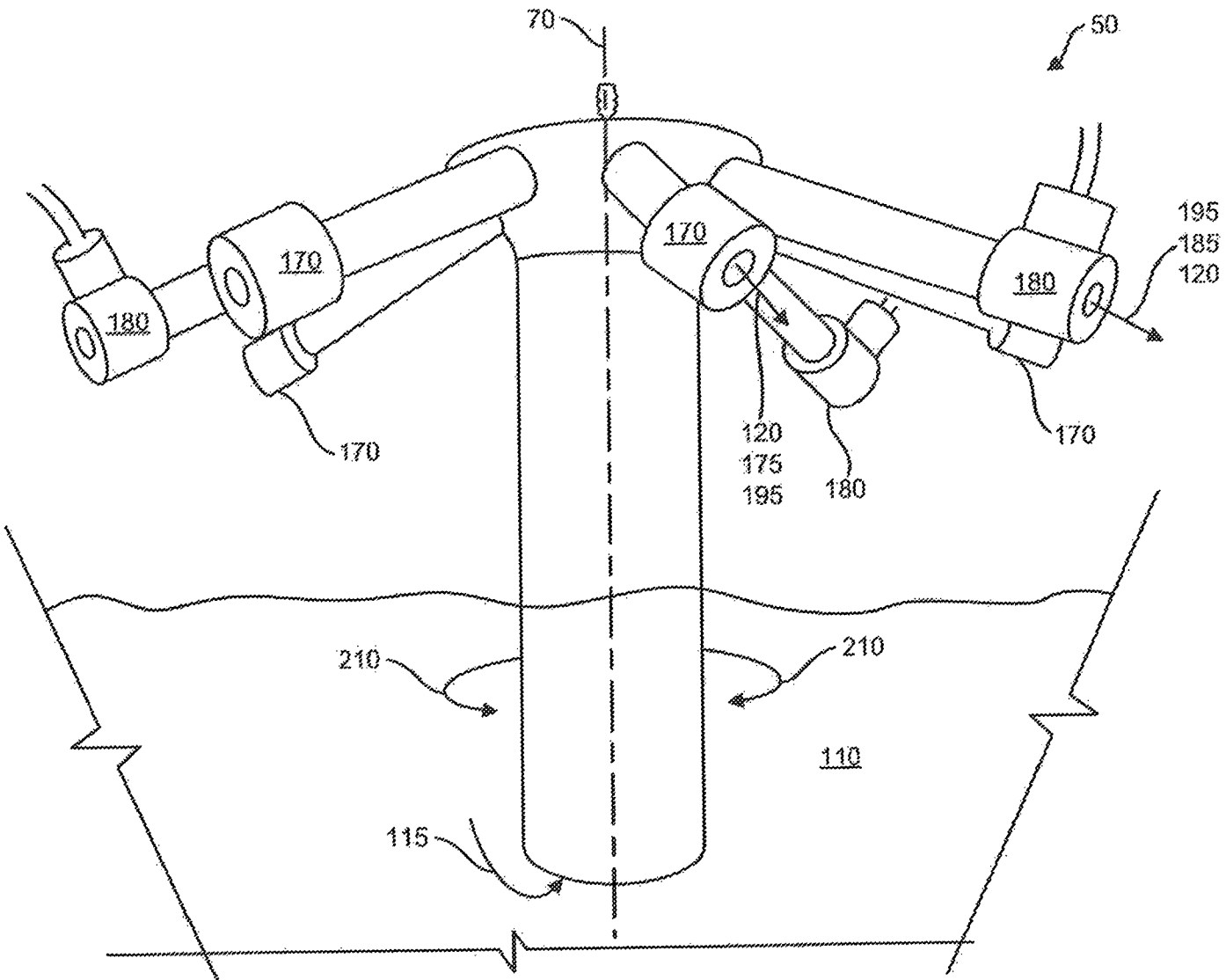
FIG. 8 is a continuation of FIG. 7 for the centrifugal pump in use utilizing the plurality of apertures disposed in the plenum chamber.

Continuing, FIG. 7 shows the cross section of FIG. 6, with the centrifugal pump 50 inlet chamber 55, the plenum chamber 75, and the aperture 95 primary end portion 160 is elevated out of the fluid 110 as shown while the inlet 55 and plenum 75 chambers are rotated 210 to start fluid communication 90, 115, 120, 150, 205, via drawing the fluid 110 through the distal end portion 60 of the first surrounding sidewall 125 through the inlet chamber 55 interior 130 towards the proximal end portion 65 of the inlet chamber 55 and then continuing the fluid communication 90, 115, 120, 150, 205 to being adjacent to the plenum chamber 75 second surrounding sidewall 135 and plenum chamber 75 interior 145 going to the primary end portion 160 of the aperture 95 thus resulting in fluid flow 90, 115, 120, 150, 205 from the distal end portion 60 of the inlet chamber 55 to the aperture 95 while the inlet 55 and plenum 75 chambers are rotated 210. Further, FIG. 8 is a continuation of FIG. 7 for the centrifugal pump 50 in use utilizing the plurality of apertures 95 disposed in the plenum chamber 75.

Figure 9:
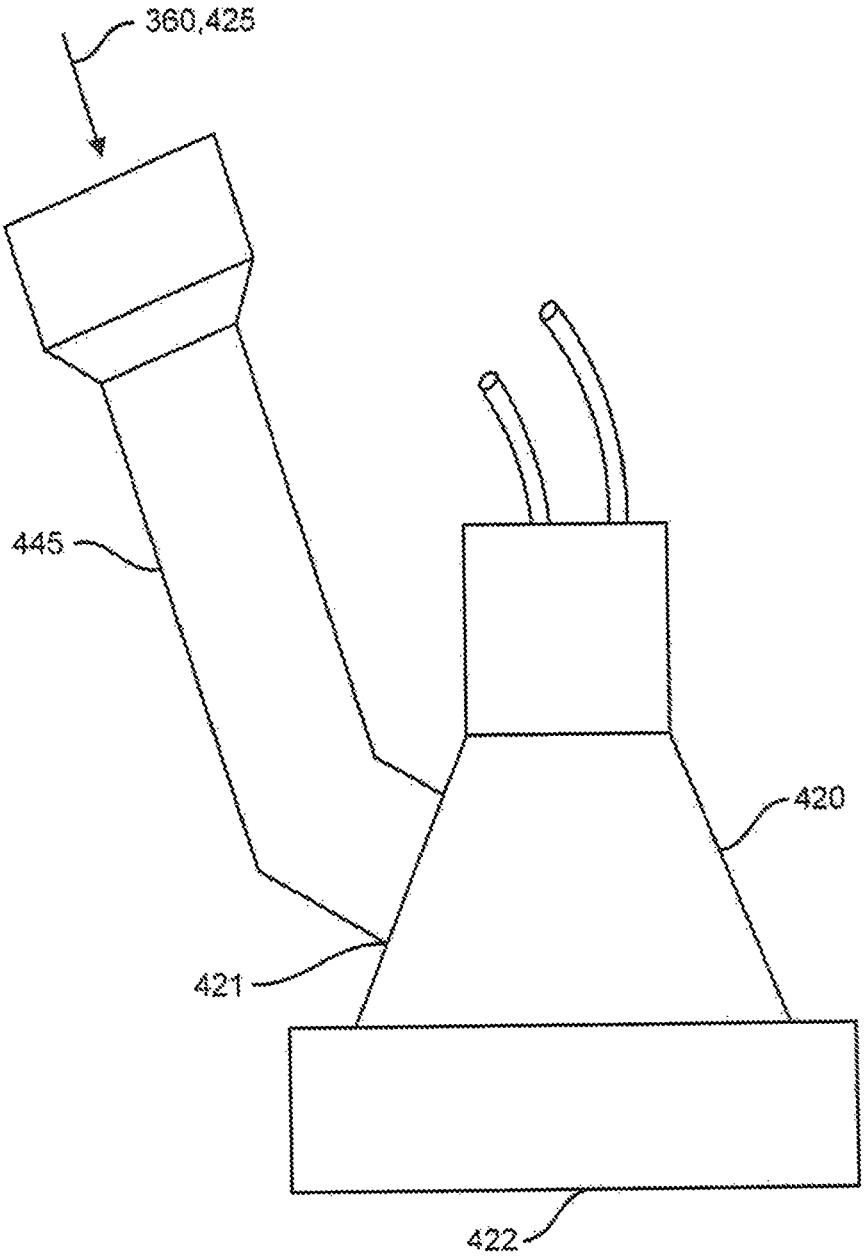
FIG. 9 shows a fluid flow electrical turbine generator that includes an inlet and an outlet with a fluid flow secondary extension element connected to the inlet showing the fluid communication to the fluid flow electrical turbine generator.

Continuing, FIG. 9 shows a fluid flow electrical turbine generator 420 that includes an inlet 421 and an outlet 422 with a fluid flow secondary extension element 445 connected to the inlet 421 showing the fluid communication 360, 425 to the fluid flow electrical turbine generator 420.

Figure 10:
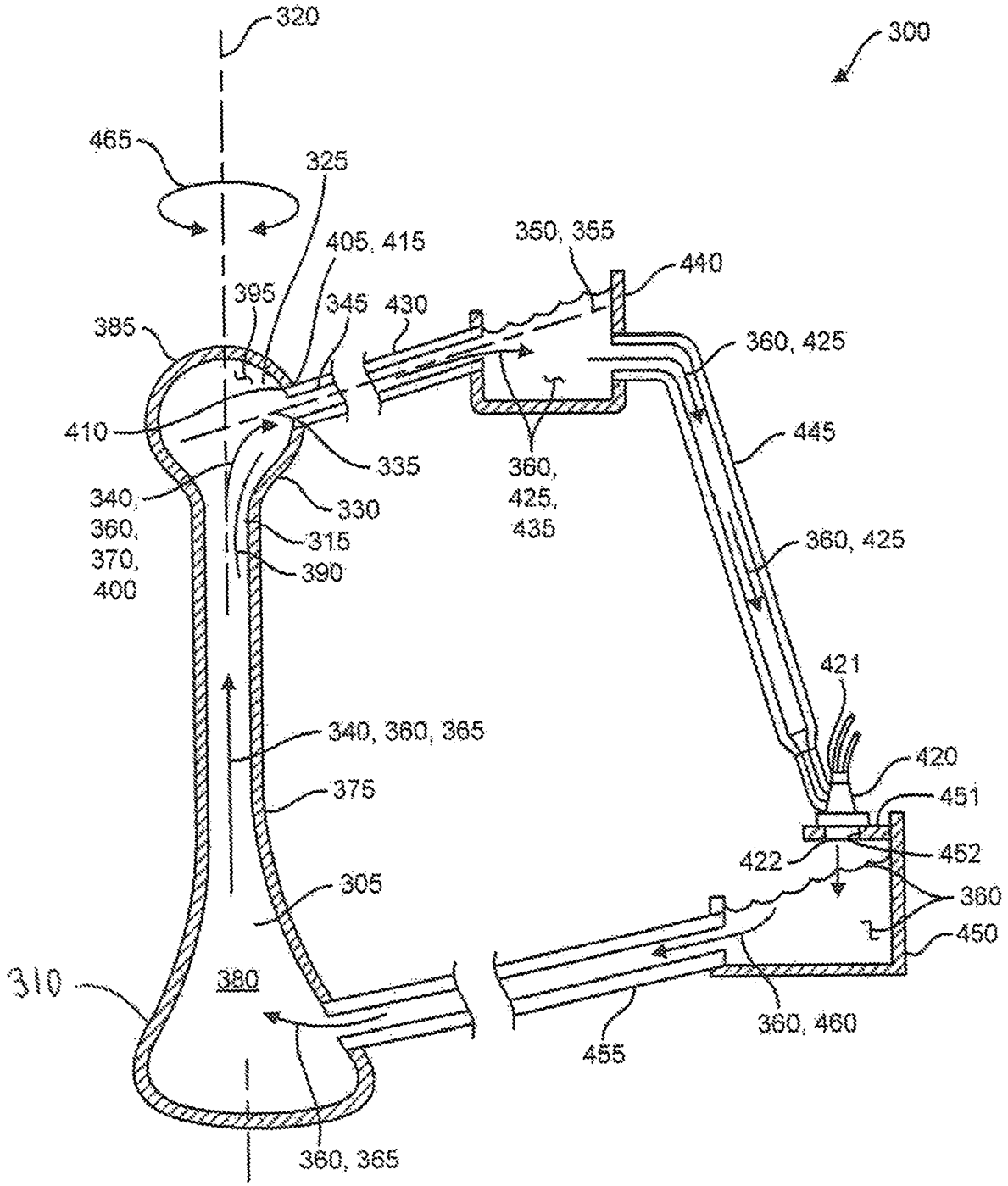
Figure 12:
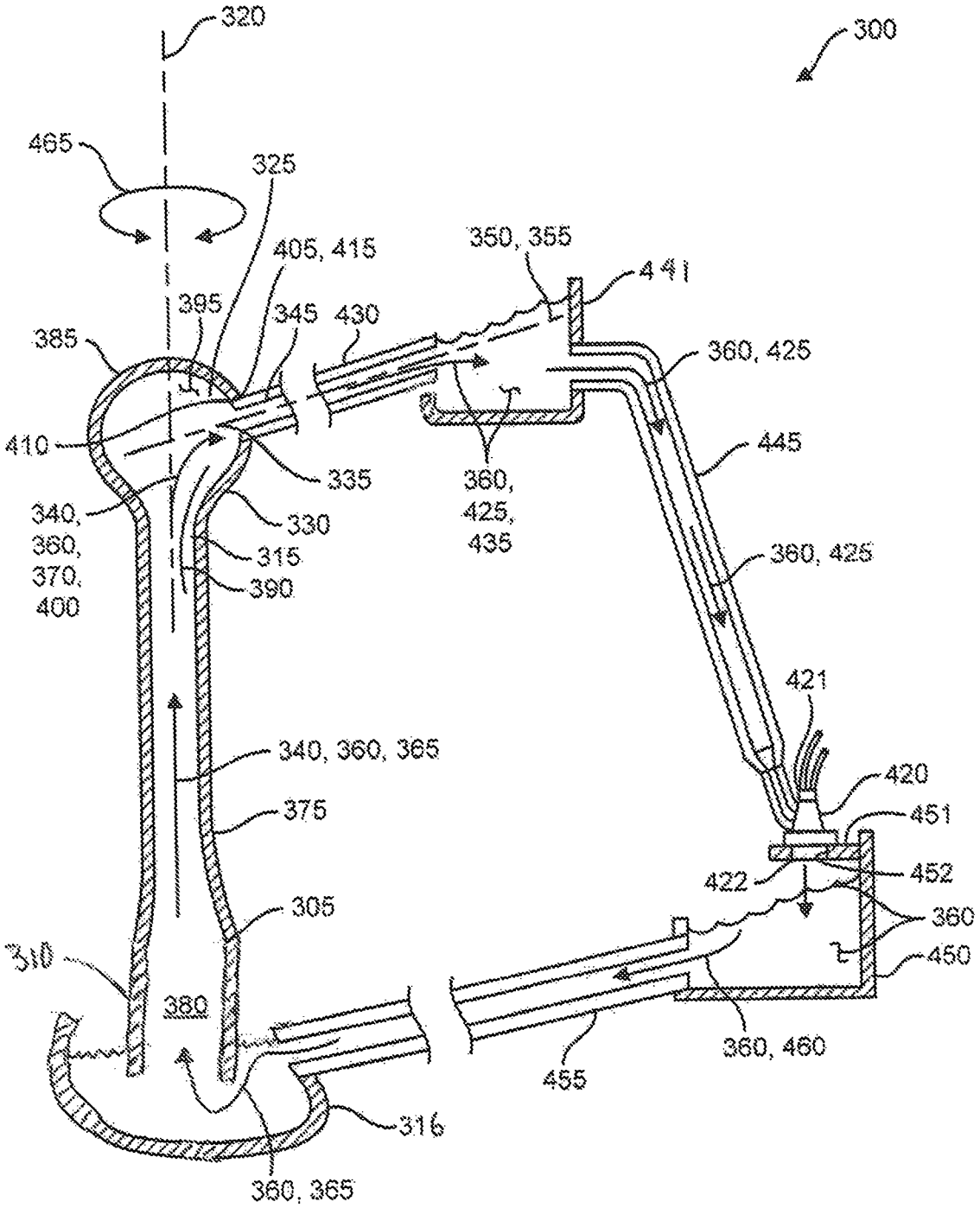

Next, FIG. 10 shows cross section cut 10-10 from FIG. 12, of the annular centrifugal pump 300, wherein FIG. 10 shows a fluid flow circuit that comes from operationally rotating 465 an inlet chamber 305, a distribution chamber 325, a fluid flow primary extension element 430, a primary open channel annulus 440, a fluid flow secondary extension element 445, the fluid flow electrical turbine generator 420, a secondary open channel annulus 450, and a fluid flow tertiary extension element 455, all rotated 365 about a rotational axis 320 to functionally cause an endless continuous loop of fluid flow 360 that includes drawing 365 a fluid 360 through a distal end portion 310 toward a proximal end portion 315 of a an inlet chamber 305. Then having fluid 360 communication 340 between the inlet chamber proximal end portion 315 and an inlet end portion 330, then toward having fluid 360 communication 400 of an inlet chamber 305 interior 380 to a distribution chamber 325 interior 395, then further discharging 370 the fluid 360 through a distribution aperture 345, toward fluid 360 communication 425 from the distribution aperture 345 to the fluid 360 flow electrical turbine generator 420 via the fluid 360 flow primary extension element 430 to a primary open channel annulus 440 via a fluid 360 flow secondary extension element 445 to the electrical turbine generator 420. Then further to a fluid 360 communication 460 from the electrical turbine generator 420 to a secondary open channel annulus 450 and then through a fluid flow tertiary extension element 455 to the inlet chamber 305. Note that the above defined fluid flow circuit is shown in the singular for clarity, however, there could be a plurality of fluid flow circuits arranged in a spoke radial fashion emanating from the inlet 305 and distribution 325 chambers as shown in FIG. 13.

Figure 11:
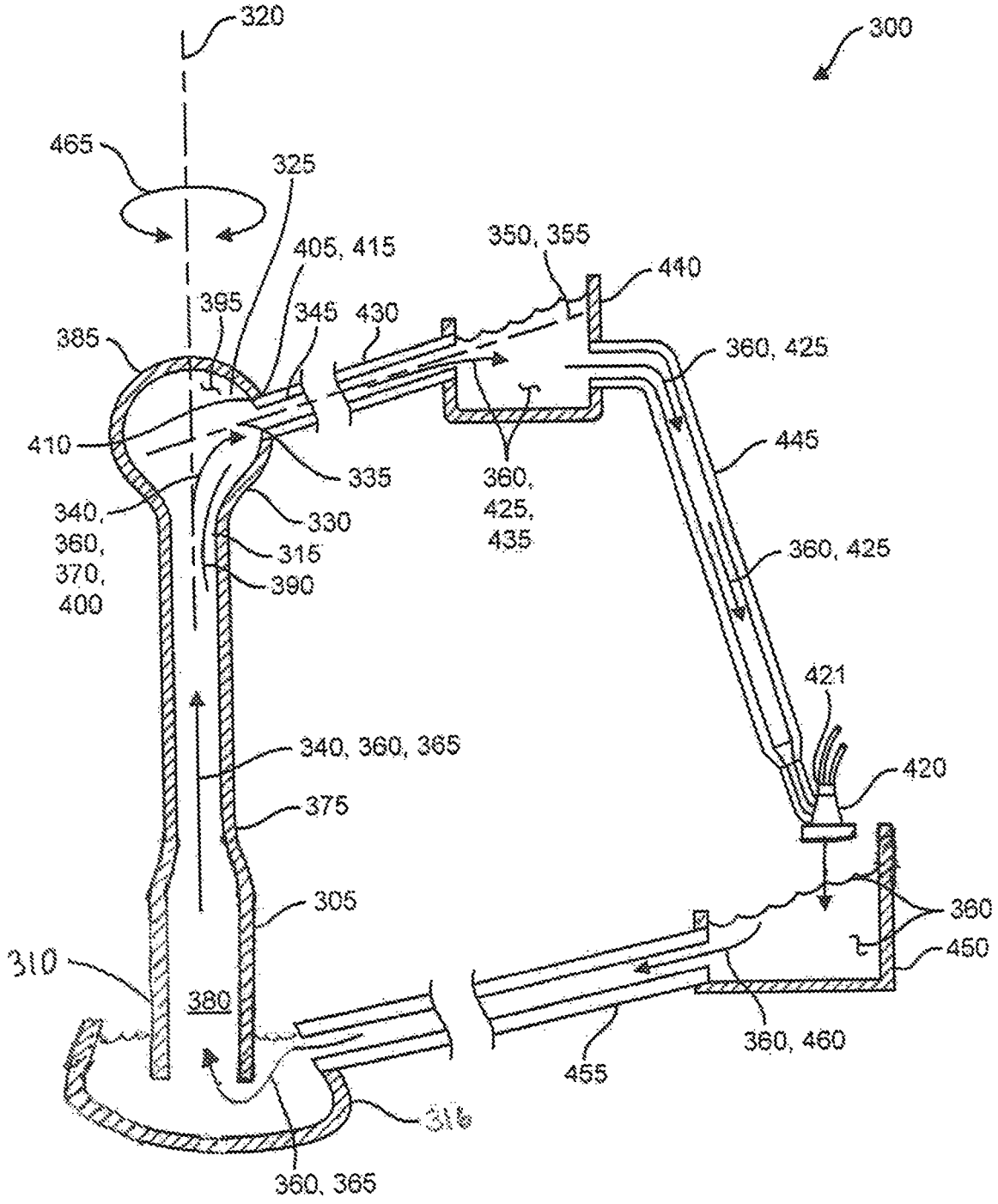
Figure 13:
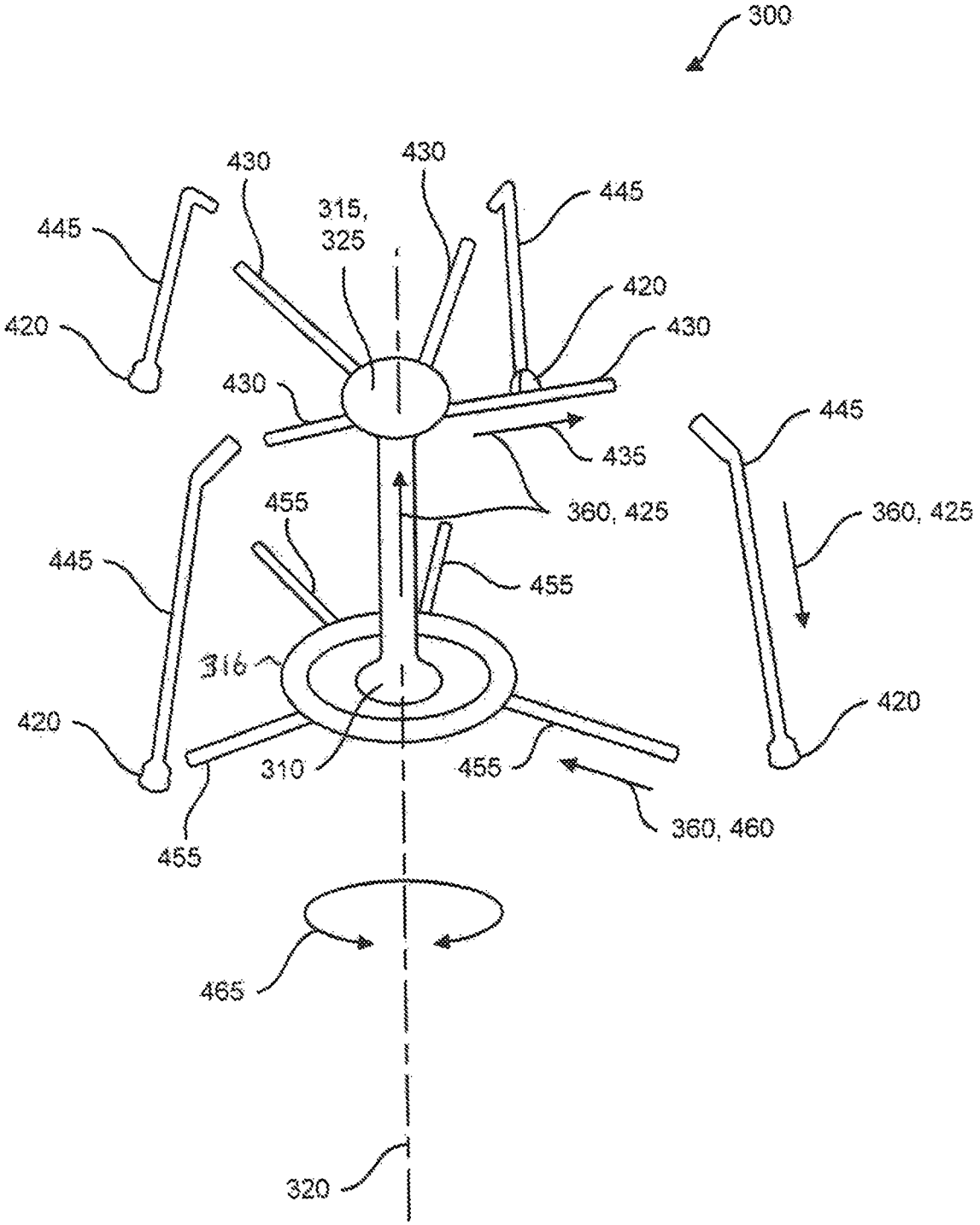
FIG. 13 shows an exploded view of the annular centrifugal pump with the primary and secondary open channel annulus removed for clarity to better show the inlet chamber, distribution chamber, the fluid flow primary extension element, the fluid flow secondary extension element, the fluid flow electrical turbine generator, and the fluid flow tertiary extension element.
Figure 14:
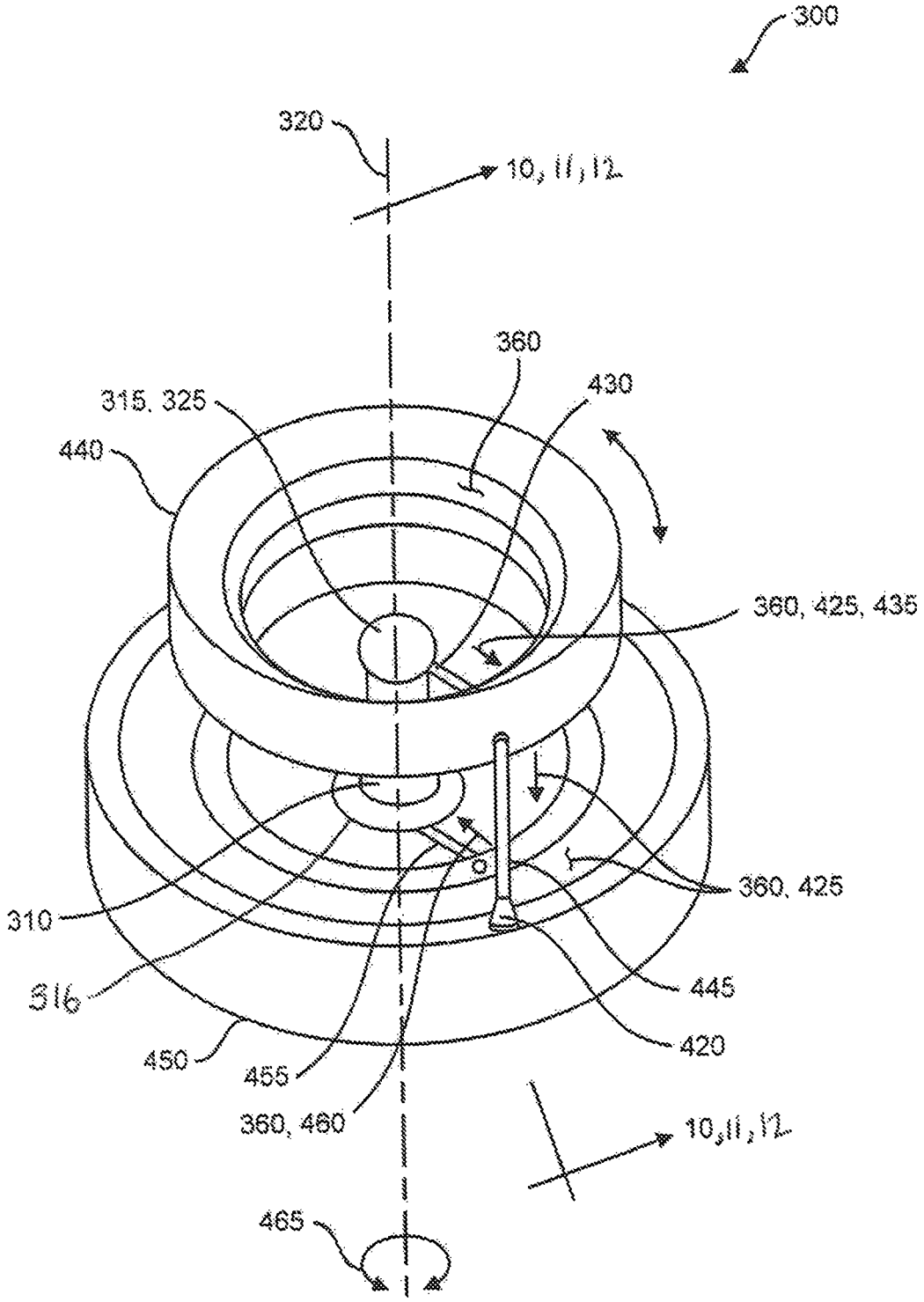
FIG. 14 shows an upper perspective view of the annular centrifugal pump showing the inlet chamber, the distribution chamber, the fluid flow primary extension element, the primary open channel annulus, the fluid flow secondary extension element, the fluid flow electrical turbine generator, the secondary open channel annulus, and the fluid flow tertiary extension element, showing the single fluid flow circuit for clarity as defined in FIG. 10 in the context of the entire annular centrifugal pump.

FIG. 11 shows cross section cut 11-11 from FIG. 14, of the annular centrifugal pump 300, wherein FIG. 11 shows a fluid flow circuit that comes from operationally rotating 465 the inlet chamber 305, the distribution chamber 325, the fluid flow primary extension element 430, the primary open channel annulus 440, the fluid flow secondary extension element 445, and the fluid flow electrical turbine generator 420 only as about the rotational axis 320, as the secondary open channel annulus 450, the fluid flow tertiary extension element 455, and the suction reservoir 316 are all static about the rotational axis 320 to functionally cause an endless continuous loop of fluid 360 flow that includes drawing 365 the fluid 360 through the suction reservoir 316 to the distal end portion 310 toward the proximal end portion 315 of a the inlet chamber 305. Then having fluid 360 communication 340 between the inlet chamber proximal end portion 315 and the inlet end portion 330, then toward having fluid 360 communication 400 of the inlet chamber 305 interior 380 to the distribution chamber 325 interior 395, then further discharging 370 the fluid 360 through the distribution aperture 345, toward fluid 360 communication 425 from the distribution aperture 345 to the fluid 360 flow electrical turbine generator 420 via the fluid 360 flow primary extension element 430 to the primary open channel annulus 440 via the fluid 360 flow secondary extension element 445 to the electrical turbine generator 420. Then to further to the fluid 360 communication 460 from the electrical turbine generator 420 to the secondary open channel annulus 450 and then through the fluid flow tertiary extension element 455 to the suction reservoir 316 and then to the inlet chamber 305. Note that the above defined fluid flow circuit is shown in the singular for clarity, however, there could be a plurality of fluid flow circuits arranged in a spoke radial fashion emanating from the common inlet 305 and distribution chamber 325 as shown in FIG. 13;

FIG. 12 shows cross section cut 12-12 from FIG. 14, of the annular centrifugal pump 300, wherein FIG. 12 shows a fluid flow circuit that comes from operationally rotating 465 the inlet chamber 305, the distribution chamber 325, and the fluid flow primary extension element 430 only about the rotational axis 320, wherein the primary open channel annulus 441, the fluid flow secondary extension element 445, the fluid flow electrical turbine generator 420, the secondary open channel annulus 450, the fluid flow tertiary extension element 455, and the suction reservoir 316 all are static about the rotational axis 320 to functionally cause an endless continuous loop of fluid 360 flow that includes drawing 365 the fluid 360 through the suction reservoir 316 to the distal end portion 310 toward the proximal end portion 315 of a the inlet chamber 305. Then having fluid 360 communication 340 between the inlet chamber proximal end portion 315 and the inlet end portion 330, then toward having fluid 360 communication 400 of the inlet chamber 305 interior 380 to the distribution chamber 325 interior 395, then further discharging 370 the fluid 360 through the distribution aperture 345, toward fluid 360 communication 425 from the distribution aperture 345 to the fluid 360 flow electrical turbine generator 420 via the fluid 360 flow primary extension element 430 to the primary open channel annulus 441 via a fluid 360 flow secondary extension element 445 to the electrical turbine generator 420. Then further to a fluid 360 communication 460 from the electrical turbine generator 420 to the secondary open channel annulus 450 and then through the fluid flow tertiary extension element 455 to the suction reservoir 316 and then to the inlet chamber 305. Note that the above defined fluid flow circuit is shown in the singular for clarity, however, there could be a plurality of fluid flow circuits arranged in a spoke radial fashion emanating from the common inlet 305 and distribution chamber 325, as shown in FIG. 13

Further, FIG. 13 shows an exploded view of the annular centrifugal pump 300 with the primary 440, 441 and secondary 450 open channel annulus removed for clarity to better show the inlet chamber 305, the distribution chamber 325, the fluid flow primary extension element 430, the fluid flow secondary extension element 445, the fluid flow electrical turbine generator 420, and the fluid flow tertiary extension element 455.

Moving onward, FIG. 14 shows an upper perspective view of the annular centrifugal pump 300 showing the inlet chamber 305, the distribution chamber 325, the fluid flow primary extension element 430, the primary open channel annulus 440, 441 the fluid flow secondary extension element 445, the fluid flow electrical turbine generator 420, the secondary open channel annulus 450, and the fluid flow tertiary extension element 455, showing the single fluid flow circuit for clarity as defined in FIGS. 10, 11, and 12 in the context of the entire annular centrifugal pump 300.

Broadly, the present invention is the centrifugal pump 50 that includes the inlet chamber 55 having the distal end portion 60 and the opposing proximal end portion 65 with the longitudinal axis 70 spanning therebetween, see FIGS. 1 and 2 in particular. Further included in the centrifugal pump 50 is the plenum chamber 75 having the inlet end portion 80 and the outlet end portion 85, the inlet end portion 80 is in fluid communication 90 with the inlet chamber 55 proximal end portion 65, the outlet end portion 85 having the aperture 95 that is about the radial axis 100 that extends radially the distance 105 outward from the longitudinal axis 70, again see FIGS. 1 and 2. Wherein operationally for the centrifugal pump 50 the inlet chamber 55 and the plenum chamber 75 are both rotated 210 about the longitudinal axis 70 wherein the fluid 110 is drawn 115 through the distal end portion 60 toward the proximal end portion 65 and ultimately discharged therethrough the aperture 95, see FIGS. 2 and 7 in particular.

As an option for the centrifugal pump 50 wherein the inlet chamber 55 is constructed of the first surrounding sidewall 125 disposed between the distal 60 and proximal 65 end portions, wherein the first sidewall 125, distal 60, and proximal 65 end portions define the inlet chamber interior 130, see FIG. 2.

Another option for the centrifugal pump 50 wherein the plenum chamber 75 is constructed of the second surrounding sidewall 135 extending from the inlet portion 80 to encompass 140 the outlet end portion 85, wherein the second sidewall 135, inlet 80, and outlet 85 end portions define a plenum chamber 75 interior 145, wherein the plenum chamber 75 interior 145 is in fluid communication 150 with the inlet chamber 55 interior 130, see FIG. 2.

Alternatively, for the centrifugal pump 50 wherein the aperture 95 is disposed therethrough 155 the second sidewall 135 and the aperture 95 having the primary end portion 160 adjacent to the plenum chamber 75 interior 145 and the aperture 95 having an opposing secondary end portion 165 external to the plenum chamber 75 interior 145, again see FIG. 2.

A further alternative for the centrifugal pump 100 is to further comprise a fluid 110 filter 170 disposed on and in fluid communication 175 with the aperture 95 secondary end portion 165, as best shown in FIGS. 2 to 5, and FIG. 8.

A continuing alternative for the centrifugal pump 50 can further comprise a fluid flow electrical generator 180 disposed on and in fluid communication 185 with the aperture 95 secondary end portion 165, as best shown in FIGS. 2 to 5, and FIG. 8.

Yet further an alternative for the centrifugal pump 50 can further comprise a fluid flow extension element 190 disposed on and in fluid communication 195 with the aperture 95 secondary end portion 165 to operationally extend the radially outward distance 105, see FIGS. 1 and 2, in particular and FIGS. 3 to 8 also.

Another alternative for the centrifugal pump 50 that can further comprise a fluid flow outward diversion element 200 disposed within the inlet chamber 55 interior 130 that is positioned adjacent to the proximal end portion 65, wherein operationally the outward diversion element 200 routes the fluid 110 flow 205 from the inlet chamber 55 interior 130 to being adjacent to the second surrounding sidewall 135 and the primary end portion 160 of the aperture 95, see in particular FIG. 7.

Looking at FIGS. 9 to 12 in particular an alternative embodiment is disclosed for the annular centrifugal pump 300 that includes the inlet chamber 305 having the distal end portion 310 and the opposing proximal end portion 315 including the inlet chamber interior 380 with the rotational axis 320 spanning therebetween as best shown in FIG. 10. Further included in the annular centrifugal pump 300 is the distribution chamber 325 having the inlet end portion 330 and the outlet end portion 335 including the distribution chamber interior 395, the inlet end portion 330 is in fluid 360 communication 340 with the inlet chamber 305 proximal end portion 315, the outlet end portion 335 having the distribution aperture 345 that is about the radial axis 350 that extends radially a distance 355 outward from the rotational axis 320, again as best shown in FIG. 10.

Also included in the annular centrifugal pump 300 is the fluid flow primary extension element 430 in fluid 360 communication 425, 435 with the distribution aperture 345, also the primary open channel annulus 440 in fluid 360 communication 425 with the fluid flow primary extension element 430, continuing the fluid flow secondary extension element 445 in fluid 360 communication with the primary open channel annulus 440, all as best shown in FIG. 10.

Next in the in the annular centrifugal pump 300 is the fluid flow electrical turbine generator 420 in fluid 360 communication 425 with the fluid flow secondary extension element 445 and the secondary open channel annulus 450 in fluid 360 communication 425 with the fluid flow electrical turbine generator 420 and the fluid flow tertiary extension element 455 in fluid 360 communication 460 with the secondary open channel annulus 450 and the inlet chamber 305, see in particular FIG. 10.

Wherein operationally rotating 465 the inlet chamber 305, the distribution chamber 325, the fluid flow primary extension element 430, the primary open channel annulus 440, the fluid flow secondary extension element 445, the fluid flow electrical turbine generator 420, the secondary open channel annulus 450, and the fluid flow tertiary extension element 455, all rotated 465 about the rotational axis 320. This is to functionally cause an endless continuous loop of fluid 360 flow 425, 435, 460 that includes drawing 365 the fluid 360 through the distal end portion 310 toward the proximal end portion 315, then fluid 360 communication 340 between the inlet chamber 305 proximal end portion 315 and the inlet end portion 330, then to fluid 360 communication 400 of the inlet chamber interior 380 to the distribution chamber interior 395, then further discharging the fluid 360 through the distribution aperture 345, toward fluid 360 communication 425 from the distribution aperture 345 to the fluid flow electrical turbine generator 420 via the fluid flow primary extension element 430 to the primary open channel annulus 440 via the fluid flow secondary extension element 445 to the electrical turbine generator 420 and then further to the fluid 360 communication 425, 460 from the electrical turbine generator 420 to the secondary open channel annulus 450 and then through the fluid flow tertiary extension element 455 to the inlet chamber 305, see FIG. 10 in particular and also FIGS. 9, 11, and 12.

Alternatively for the annular centrifugal pump 300 the inlet chamber 305 can be constructed of the first surrounding sidewall 375 disposed between the distal 310 and proximal 315 end portions, wherein the first sidewall 375, distal 310, and proximal 315 end portions define the inlet chamber interior 380, see FIG. 10.

A further alternative for the annular centrifugal pump 300 the distribution chamber 325 can be constructed of the second surrounding sidewall 385 extending from the inlet portion 330 to encompass the outlet end portion 335, wherein the second surrounding sidewall 385, inlet 330, and outlet 335 end portions define the distribution chamber interior 395, wherein the distribution chamber interior 395 is in fluid 360 communication 400 with the inlet chamber 305 interior 380, as best shown in FIG. 10.

Optionally for the annular centrifugal pump 300 the distribution aperture 345 is disposed therethrough the second sidewall 385 and the distribution aperture 345 having the primary end portion 410 adjacent to the distribution chamber interior 395 and the distribution aperture 345 having an opposing secondary end portion 415 external to the distribution chamber interior 395, also see FIG. 10.

Another option for the annular centrifugal pump 300 wherein the fluid flow primary extension element 430 has a radial axis 350 that is positioned to extend 355 in a radially outward distance from the rotational axis 320 to operationally enhance the endless continuous loop of fluid 360 flow 340, 370, 400, 425, 435, 460 as shown in FIG. 10.

Also an option for the annular centrifugal pump 300 wherein the secondary open channel annulus 450 further comprises the support 451 including the support aperture 452, wherein the support 451 retains the fluid flow electrical turbine generator 420 partially within the secondary open channel annulus 450 such that the outlet 422 of the fluid flow electrical turbine generator 420 is lined up with the support 451 aperture 452 to allow fluid 360 to discharge 460 into the secondary open channel annulus 450 therethrough the support 451 aperture 452 from the outlet 422 of the fluid flow electrical turbine generator 420, as seen in FIG. 10.

Another option for the annular centrifugal pump 300 is wherein the secondary open channel annulus 450 can extend inward toward the rotational axis 320 to shorten the fluid flow tertiary extension element 455 to be less than the fluid flow primary extension element 430 to operationally enhance the endless continuous loop of fluid 360 flow 340, 370, 400, 425, 435, 460 as shown in FIG. 10.

Looking at FIG. 11 in particular for the annular centrifugal pump 300 that can further comprise the open suction reservoir 316 that is affixed to and in fluid communication with the fluid flow tertiary extension element 455, wherein the open suction reservoir 316 is also in fluid communication with the distal end portion 310 of the inlet chamber 305, wherein operationally the open suction reservoir 316 rotationally decouples the fluid flow tertiary extension element 455 and the inlet chamber 305, such that the open suction reservoir 316, the fluid flow tertiary extension element 455, and the secondary open channel annulus 450 are all static in relation to the rotational axis 320. This is to operationally enhance the endless continuous loop of fluid 360 flow 340, 370, 400, 425, 435, 460 as shown in FIG. 11.

Looking at FIG. 12 in particular for the annular centrifugal pump 300 that can further comprise the open suction reservoir 316 that is affixed to and in fluid communication with the fluid flow tertiary extension element 455, wherein the open suction reservoir 316 is also in fluid communication with the distal end portion 310 of the inlet chamber 305, wherein operationally the open suction reservoir 316 rotationally decouples the fluid flow tertiary extension element 455 and the inlet chamber 305, such that the open suction reservoir 316, the fluid flow tertiary extension element 455, the secondary open channel annulus 450, the fluid flow electrical turbine generator 420, the fluid flow secondary extension element 445, and the primary open channel annulus 441 are all static in relation to the rotational axis 320, wherein further the primary open channel annulus 441 is structurally configured to be rotationally decoupled from the fluid flow primary extension element 430. This is to operationally enhance the endless continuous loop of fluid 360 flow 340, 370, 400, 425, 435, 460 as shown in FIG. 12.

CONCLUSION

Accordingly, the present invention of a centrifugal pump has been described with some degree of particularity directed to the embodiments of the present invention. It should be appreciated, though; that the present invention is defined by the following claim construed in light of the prior art so modifications of the changes may be made to the exemplary embodiments of the present invention without departing from the inventive concepts contained therein.

The invention claimed is:

1. An annular centrifugal pump comprising:

(a) an inlet chamber having a distal end portion and an opposing proximal end portion including an inlet chamber interior with a rotational axis spanning therebetween; and (b) a distribution chamber having an inlet end portion and an outlet end portion including a distribution chamber interior, said inlet end portion is in fluid communication with said inlet chamber proximal end portion, said outlet end portion having a distribution aperture that is about a radial axis that extends radially a distance outward from said rotational axis;

(c) a fluid flow primary extension element in fluid communication with said distribution aperture;

(d) a primary open channel annulus in fluid communication with said fluid flow primary extension element;

(e) a fluid flow secondary extension element in fluid communication with said primary open channel annulus;

(f) a fluid flow electrical turbine generator in fluid communication with said fluid flow secondary extension element;

(g) a secondary open channel annulus in fluid communication with said fluid flow electrical turbine generator; and (h) a fluid flow tertiary extension element in fluid communication with said secondary open channel annulus and said inlet chamber, wherein operationally rotating structurally in rotational lock step; said inlet chamber, said distribution chamber, said fluid flow primary extension element, said primary open channel annulus, said fluid flow secondary extension element, said fluid flow electrical turbine generator, said secondary open channel annulus, and said fluid flow tertiary extension element, all about said rotational axis to functionally cause a continuous loop of fluid flow during operation that includes drawing the fluid through said distal end portion toward said proximal end portion, then fluid communication between said inlet chamber proximal end portion and said inlet end portion, then to fluid communication of said inlet chamber interior to said distribution chamber interior, then further discharging the fluid through said distribution aperture, resulting in fluid communication from said distribution aperture to said fluid flow primary extension element to said primary open channel annulus to said fluid flow secondary extension element to said electrical turbine generator and then further to the fluid communication from said electrical turbine generator to said secondary open channel annulus and then through said fluid flow tertiary extension element to said inlet chamber.

2. An annular centrifugal pump according to claim 1 wherein said inlet chamber is constructed of a first surrounding sidewall disposed between said distal and proximal end portions, wherein said first sidewall, distal, and proximal end portions define an inlet chamber interior.

3. An annular centrifugal pump according to claim 2 wherein said distribution chamber is constructed of a second surrounding sidewall extending from said inlet portion to encompass said outlet end portion, wherein said second surrounding sidewall, inlet, and outlet end portions define a distribution chamber interior, wherein said distribution chamber interior is in fluid communication with said inlet chamber interior.

4. An annular centrifugal pump according to claim 3 wherein said distribution aperture is disposed therethrough said second sidewall and said distribution aperture having a primary end portion adjacent to said distribution chamber interior and said distribution aperture having an opposing secondary end portion external to said distribution chamber interior.

5. An annular centrifugal pump according to claim 4 wherein said fluid flow primary extension element has a radial axis that is positioned to extend in a radially outward distance from said rotational axis to operationally enhance said continuous loop of fluid flow.

6. An annular centrifugal pump according to claim 5 wherein said secondary open channel annulus further comprises a support including a support aperture, wherein said support retains said fluid flow electrical turbine generator partially within said secondary open channel annulus such that an outlet of said fluid flow electrical turbine generator is lined up with said support aperture to allow fluid to discharge into said secondary open channel annulus therethrough said support aperture from said outlet of said fluid flow electrical turbine generator.

7. An annular centrifugal pump according to claim 5 wherein said secondary open channel annulus extends inward toward said rotational axis to shorten said fluid flow tertiary extension element to be less than said fluid flow primary extension element to operationally enhance said continuous loop of fluid flow.

* * * * *